US008650699B1

(12) United States Patent
Kovarik

(10) Patent No.: US 8,650,699 B1
(45) Date of Patent: Feb. 18, 2014

(54) SCRUBBER ADAPTED FOR CLEANING A SIDE SURFACE OF A RAIN GUTTER

(76) Inventor: Andrew C. Kovarik, Edwardsville, IL (US)

( * ) Notice: Subject to any disclaimer, the term of this patent is extended or adjusted under 35 U.S.C. 154(b) by 76 days.

(21) Appl. No.: 13/489,986

(22) Filed: Jun. 6, 2012

Related U.S. Application Data

(63) Continuation of application No. 12/909,670, filed on Oct. 21, 2010, now Pat. No. 8,266,756, which is a continuation-in-part of application No. 12/143,013, filed on Jun. 20, 2008, now abandoned.

(60) Provisional application No. 61/253,689, filed on Oct. 21, 2009.

(51) Int. Cl.
*A47L 13/16* (2006.01)

(52) U.S. Cl.
USPC ..... 15/244.2; 15/244.1; 15/144.2; 15/210.1

(58) Field of Classification Search
USPC ..... 15/210.1, 244.1, 244.2, 228, 144.1, 15/144.2
See application file for complete search history.

(56) References Cited

U.S. PATENT DOCUMENTS

| | | | | |
|---|---|---|---|---|
| 531,433 | A | | 12/1894 | Brooks |
| 608,365 | A | | 8/1898 | Goehring |
| 1,284,992 | A | | 11/1918 | Belknap |
| 1,586,337 | A | | 5/1926 | Stockwell |
| 2,042,546 | A | | 6/1936 | Meier |
| 3,214,779 | A | | 11/1965 | Wheeler |
| 3,339,220 | A | | 9/1967 | Barry |
| 3,346,900 | A | | 10/1967 | Stewart et al. |
| 3,383,158 | A | * | 5/1968 | Leland ..... 401/201 |
| 3,713,744 | A | | 1/1973 | Sims |
| 3,761,990 | A | | 10/1973 | Lynn |
| 4,114,223 | A | | 9/1978 | Buchanan |
| 4,255,827 | A | | 3/1981 | Palazzo |
| 4,455,705 | A | | 6/1984 | Graham |
| 4,531,254 | A | | 7/1985 | Abrahamsen |
| 4,554,699 | A | | 11/1985 | Simmons |
| 4,580,307 | A | | 4/1986 | Moss |
| 4,663,796 | A | * | 5/1987 | Helling et al. ..... 15/144.2 |
| 4,763,377 | A | * | 8/1988 | Madsen ..... 15/144.2 |
| 4,970,750 | A | | 11/1990 | Davis, III |
| 5,058,233 | A | | 10/1991 | Davis, III |
| 5,177,831 | A | | 1/1993 | Wirth |
| 5,197,237 | A | | 3/1993 | Owens |
| 5,361,442 | A | | 11/1994 | Payne |
| 5,419,015 | A | | 5/1995 | Garcia |
| 5,634,232 | A | | 6/1997 | Brenneman |
| 5,839,147 | A | * | 11/1998 | Chia-Yi et al. ..... 15/119.2 |
| D417,324 | S | | 11/1999 | Farls |

(Continued)

*Primary Examiner* — Mark Spisich
*Assistant Examiner* — Andrew A Horton
(74) *Attorney, Agent, or Firm* — Grace J. Fishel

(57) ABSTRACT

A scrubber for rain gutters with a scrubbing pad having a profile complementary to the profile of the outside side face of the gutter. The scrubbing pad is formed of a open cell natural or synthetic sponge and is attached to a substantially flat backing plate and makes substantially 100% surface contact with the outside side face of the rain gutter. The scrubbing pad overlaps a flange at the top of the outside side face of the gutter and overlaps a bottom of the rain gutter at the bottom of the outside side face. The scrubber is guided by the scrubbing pad along the rain gutter in a straight line by the overlapping portions of the scrubbing pad as the scrubber is moved back and forth along the rain gutter.

10 Claims, 3 Drawing Sheets

(56) References Cited

U.S. PATENT DOCUMENTS

| | | | | |
|---|---|---|---|---|
| D433,819 | S | 11/2000 | Thunderchild | |
| 6,199,241 | B1 | 3/2001 | Anumah | |
| 6,772,466 | B2 | 8/2004 | Ziegler | |
| 7,210,188 | B1 * | 5/2007 | Kirby | 15/244.4 |
| 7,296,943 | B2 | 11/2007 | Sandoval | |
| 7,850,386 | B2 * | 12/2010 | Bensussan et al. | 403/53 |
| 2002/0120996 | A1 * | 9/2002 | Kaminstein | 15/228 |
| 2003/0159714 | A1 * | 8/2003 | Licciardi | 134/6 |
| 2004/0000020 | A1 | 1/2004 | Li | |
| 2004/0064909 | A1 * | 4/2004 | Locklear | 15/160 |
| 2006/0099025 | A1 | 5/2006 | Hann | |
| 2006/0117510 | A1 | 6/2006 | Sellers | |
| 2007/0022555 | A1 * | 2/2007 | Penzes | 15/244.2 |
| 2007/0061987 | A1 | 3/2007 | Kresse et al. | |

* cited by examiner

SCRUBBER ADAPTED FOR CLEANING A SIDE SURFACE OF A RAIN GUTTER

This application is a continuation-in-part of Ser. No. 12/909,670, filed Oct. 21, 2010, now U.S. Pat. No. 8,266,756, which claims priority from provisional application Ser. No. 61/253,689, filed Oct. 21, 2009 and which is a continuation-in-part of Ser. No. 12/143,013, filed Jun. 20, 2008, abandoned.

BACKGROUND OF THE INVENTION

1. Field of the Invention

The present invention relates to a scrubber for washing the exposed side surface of a rain gutter.

2. Brief Description of the Prior Art

Rain gutters are typically installed along the eave line of a structure to facilitate the collection and transport of rainwater from the roof of the structure to the ground. Over time, the exterior of a gutter collects dirt which becomes a food source for mildew, mold and algae, colonies of which are particularly likely to form on the shady side of a building. Sugar pollens and roof material runoff also stain gutters and can take on the appearance of what is called "tiger strips" on the gutters. One of the most dreaded home care projects is washing the outside of gutters because they are hard to reach without using a ladder which is dangerous and frequently difficult to place because of obstacles such as bushes and the like.

Until the present invention, the best way to clean the side surface of a rain gutter has been with a soft brush on a pole, such as sold for cleaning the sides of RVs or windows. The brush is dipped into a cleaning solution and an area of the gutter is scrubbed and then rinsed with clear water. One problem with RV type brushes, however, is that the bristles do not make full contact with the contoured surface of the gutter and/or apply unequal pressure to the contour surface resulting in uneven cleaning.

BRIEF SUMMARY OF THE INVENTION

In view of the above, it is an object of the present invention to provide a scrubber that effectuates an effective scrubbing action along the entire side face of a rain gutter with substantially 100% even surface contact. It is another object to provide a scrubber that is mounted on a double swivel joint such that it can be operated from the ground and apply substantially constant pressure to the side face. Other objects and features of the invention will be in part apparent and in part pointed out hereinafter.

In accordance with the invention a scrubber is provided for making substantially 100% surface contact with the outside side face of a rain gutter for effectively removing dirt, stains and debris safely from the ground. The scrubber includes a backing plate with a removable scrubbing pad and a handle which is connected with a double swivel joint assembly to the flat backing plate. The scrubbing pad has a bottom surface complementary to the ogee-curve portion of the side face of the rain gutter, complementary to an upwardly extending portion of the rain gutter and overlapping a portion of a flat flange at the top and complementary to a downwardly extending portion of the rain gutter and overlapping a portion of the flat floor of the gutter. The scrubbing pad is formed of an open cell sponge which does not stick to the rain gutter and is aggressive enough to remove the dirt, stains and debris when used with an effective cleaning solution.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 2:
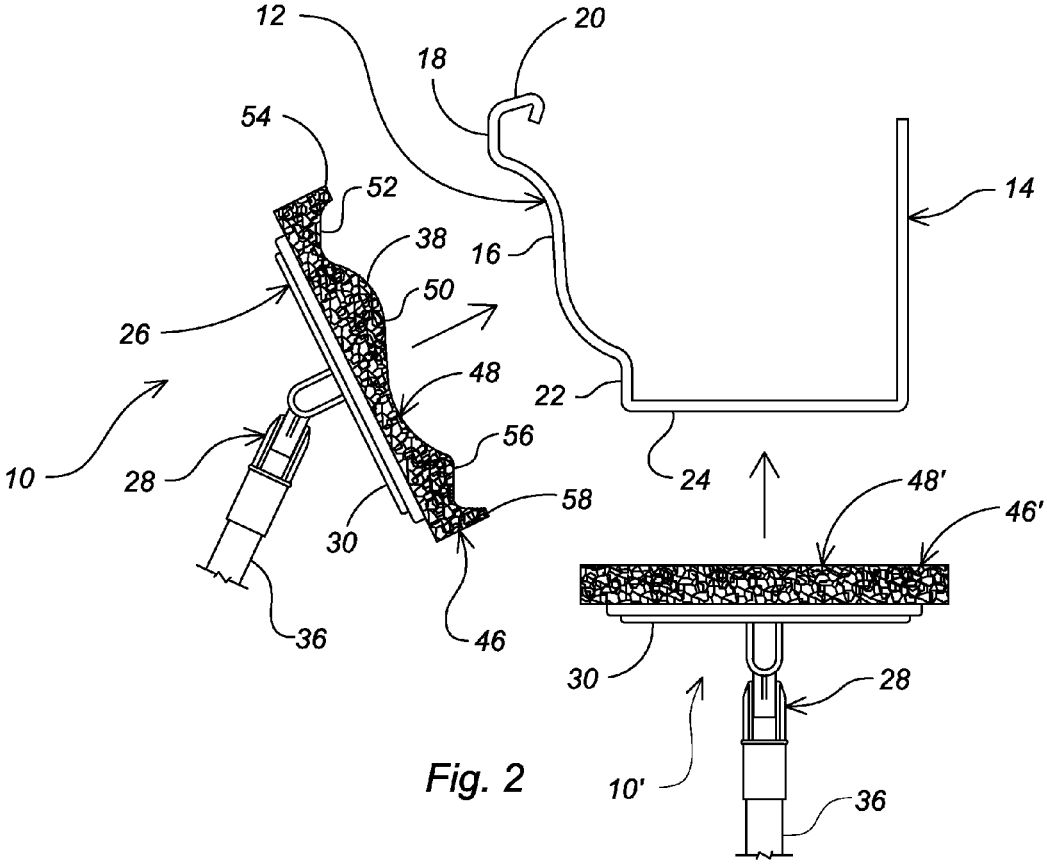
FIG. 2 is a side elevation of the first scrubber together with a second flat-faced scrubber for use in cleaning the outside bottom of the rain gutter.

Referring to the drawings more particularly by reference character, a scrubber 10 is provided for use in scrubbing an outside side face 12 of a rain gutter 14. As best seen in FIG. 2, the outside side face 12 has a ogee-curve portion 16, an upwardly extending portion 18 terminating in a substantially flat flange 20 and a downwardly extending portion 22 connecting to a flat bottom 24. Scrubber 10 may be provided in different sizes. For example, a G5 model may be provided to fit standard 5 inch aluminum "K" style gutters commonly found on most homes and a G6 model may be provided to fit 6 inch oversized gutters such are found on larger homes, churches, etc. Flat bottom 24 on the smaller gutters is approximately 3⅜ inches wide and on larger gutters is approximately 3⅞ inches wide.

Figure 1:
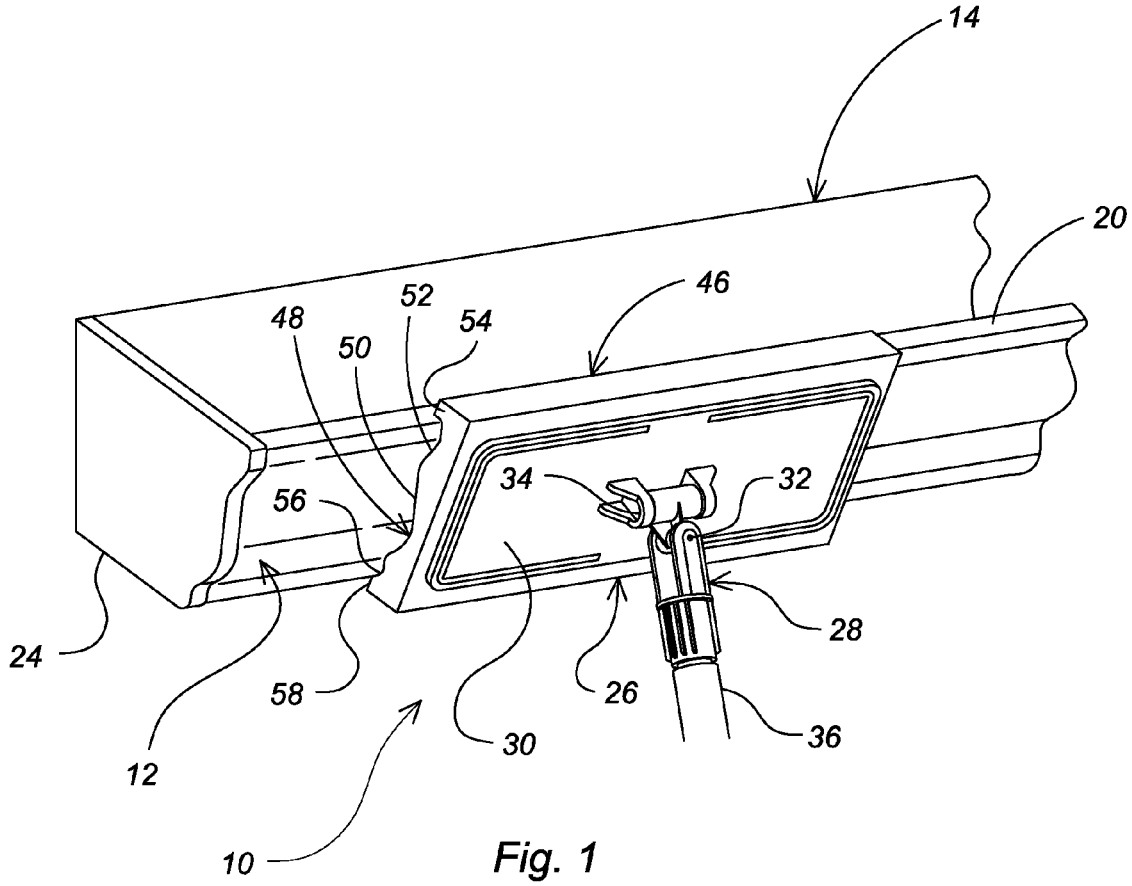
FIG. 1 is a perspective view of a first scrubber in accordance with present invention in use cleaning an outside side face of a rain gutter.

Scrubber 10 includes a substantially flat backing plate 26 with a double swivel joint assembly 28 attached to a top surface 30. As shown in FIG. 1, double swivel joint assembly 28 has a vertical swivel joint 32 and a horizontal swivel joint 34. Vertical swivel joint 32 allows rotation of backing plate 26 from side to side and horizontal swivel joint 34 allows rotation of a backing plate 26 up and down. Double swivel joint assembly 28 may be provided with threads (not shown) to fit the threads (not shown) on a standard threaded pole 36. In other instances, double swivel joint assembly 28 may be adapted to be friction fitted to pole 36. Horizontal swivel joint 34 and/or vertical swivel joint 32 may be restricted from moving freely for holding the pivot in a selected position. With other commercially available double swivel joint assemblies 28 no special provision is made for restricting either of swivel joints 32, 34.

Figure 5:
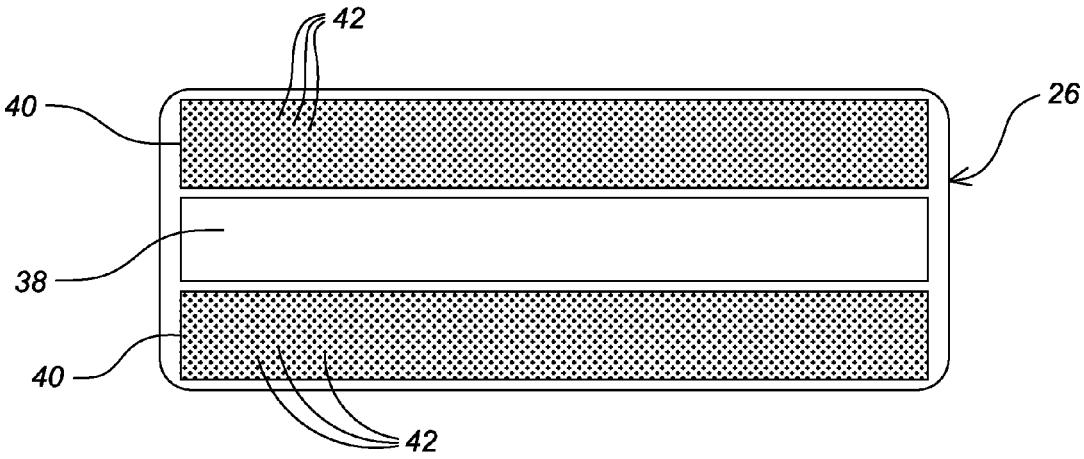

As best seen in FIG. 5, a bottom surface 38 of backing plate 26 has is fabricated with hookstrips 40. Each of hookstrips 40 has an array of fastening elements 42. Typically, the fastening elements 42 are hook-like or mushroom-like elements which extend from a base with the individual hooks or mushrooms having undersides spaced away from the base. Hookstrips 40 are typically manufactured as a separate product and attached to bottom surface 38 of backing plate 26 although they may be integrally formed with backing plate 26.

Figure 3:
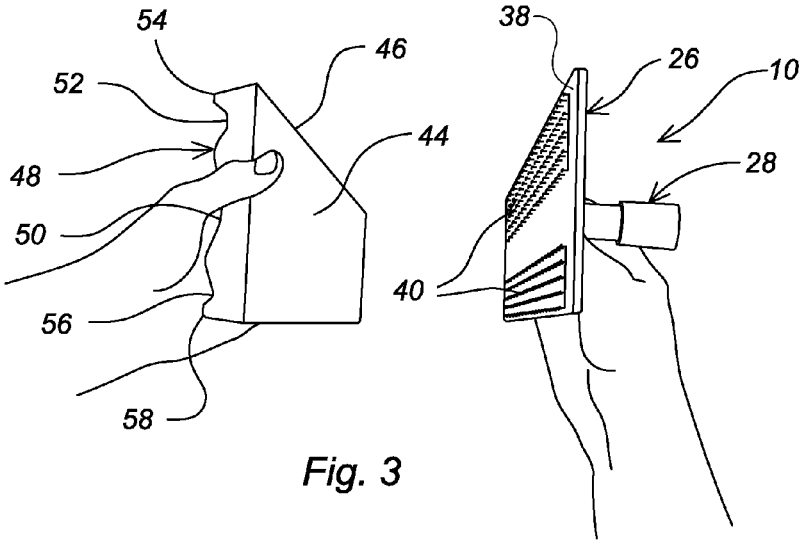
FIG. 3 is a perspective view of a scrubbing pad in accordance with the present invention being attached to a backing plate with a double swivel joint assembly.
Figure 4:
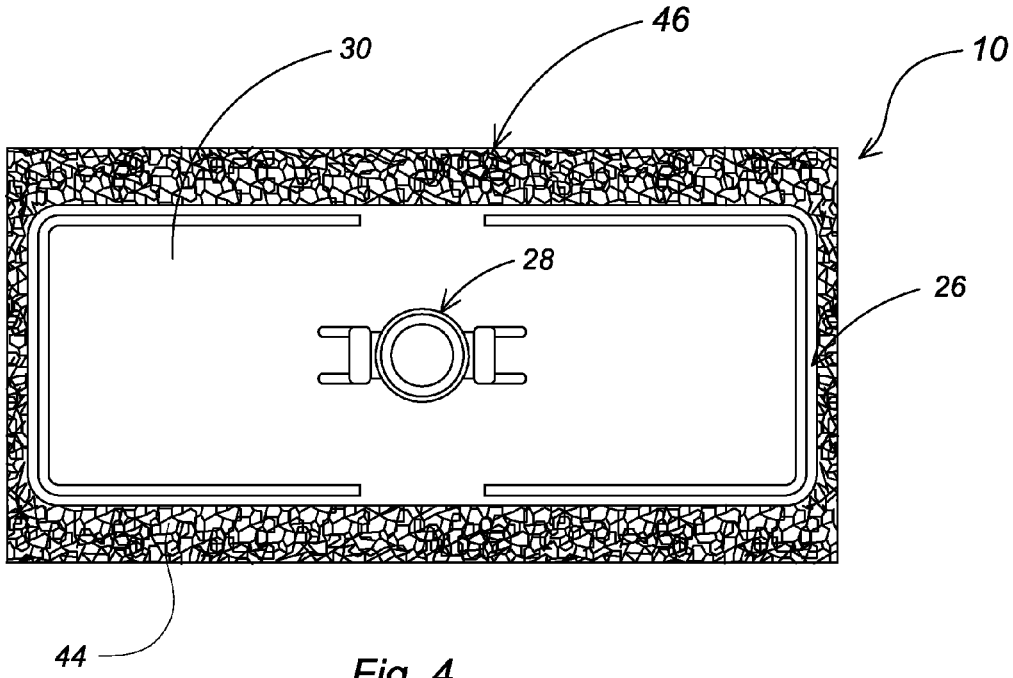
FIG. 4 is a top plan view of the scrubbing pad attached to the backing plate with the double swivel joint assembly; and, FIG. 5 is a bottom plan view of a bottom surface of the backing plate with two rows of hookstrips for use attaching the scrubbing pad to the backing plate.

A top surface 44 of a removable scrubbing pad 46 is attached to bottom surface 38 of the backing plate as shown in FIG. 3 with hookstrips 40. Additionally or alternatively, slides, clips, elastic string and other suitable attachments may be employed to releasibly secure scrubbing pad 46 to bottom surface 38 of backing plate 26.

Scrubbing pad 46 is formed of an open cell natural or synthetic sponge rubber that keeps its shape and is not affected by cleaners or bleach. Closed cell sponge materials are not preferred because they tend to suction attach to side surface 12 of rain gutter 14. Foamed polyurethanes such as open celled polyethers or polyesters are suitable and may be reticulated by breaking the cell walls by thermal or chemical means. The reticulated open cell construction allows for fluids to permeate the scrubbing pad to a greater degree than closed-cell materials and their lower tensile strength allows them to conform to contours more easily. With polyester and polyether open cell sponges, larger open cells create more friction/drag than smaller cells, and thus provide more aggressive scrubbing action, and too small cells may not provide an aggressive enough scrubbing action. A balance between drag and abrasiveness with open cell polyester sponges has been found when the cell count is between about 2 and 25 PPI (pores per linear inch), more preferably between about 8 and 20 PPI. In the case of open cell polyester sponges, very good result been obtained when the cell count was between about 12 and 18 PPI. In some instances, polyethers are preferred because polyether foams are more resistance to hydrolysis that polyester foams. When the open cell sponge is polyether, very good results have been obtained with a PPI of 20 plus or minus 10 PPI.

Top surface 44 of scrubbing pad 46 is attached with hookstrips 40 to bottom surface 38 of backing plate 26 with the hook-like or mushroom-like elements of hookstrips 40 which latch into the reticulated open cells of scrubbing pad 46. A bottom surface 48 of scrubbing pad 46 is complementary 50 to the ogee-curve portion of side face 16, complementary 52 to the upwardly extending portion and overlapping 54 a portion of the flat flange and complementary 56 to the upwardly extending portion and overlapping 58 a portion of the flat floor.

In use, scrubber 10 is attached to pole 36. Pole 36 may be telescoping in a known manner. This adjustability allows scrubber 10 with pole 36 to reach gutters 14 of different heights and to be conveniently stored when not in use. Prior to starting use of scrubber 10, rain gutters 14 may be sprayed with water and the dirt, stains and debris allowed to soak and soften. With pole 36 acting as a handle, a user may press scrubbing pad 46 wetted with a cleaning agent against outside side face 12 of the rain gutter with complementary overlapping flat flange portion 54 and complementary overlapping flat bottom portion 58 contacting flat flange 20 and flat bottom 24 respectively. Because scrubbing pad 46 is an open cell sponge it makes very conservative use of the cleaning solution because it does not absorb much of the cleaning solution.

While pressing inwardly and moving scrubber 10 back and forth along rain gutter 14, complementary portions 54, 58 effectively guide scrubbing pad 46 in a straight line along gutter 14 making substantially 100% cleaning contact with outside side surface 12. A second scrubber 10' as shown in FIG. 2 may be provided to clean flat bottom 24. Second scrubber 10' may be similar to first scrubber 10 except that a bottom surface 48' of scrubbing pad 46' is flat, not congruent with the configuration of the side surface of the rain gutter. As will be readily apparent, only one backing plate 26 is needed for both scrubbers 10, 10' by interchanging scrubbing pads 46, 46'. To extend the useful life of scrubbing pads 46, 46' they should not be left standing in cleaning solution for long periods of time particularly if bleach is used as the cleaning solution. It is also advisable to rinse scrubbing pads 46, 46=with clean water after completing a job.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A scrubber for the outside side face of a rain gutter having a ogee-curve portion, an upwardly extending portion terminating in a flat flange and a downwardly extending portion terminating in a flat floor, said scrubber comprising a substantially flat backing plate with a removable scrubbing pad and a handle, said handle connected with a double swivel joint assembly to the flat backing plate, said scrubbing pad having a bottom surface complementary to the ogee-curve portion of the side face of the rain gutter, complementary to the upwardly extending portion and overlapping a portion of the flat flange and complementary to the downwardly extending portion and overlapping a portion of the flat floor, said scrubbing pad formed of an open cell sponge.

2. The scrubber of claim 1 wherein the scrubbing pad is connected to the substantially flat backing plate with hook-like or mushroom-like fastening elements.

3. The scrubber of claim 1 wherein the scrubbing pad is formed of a reticulated open cell synthetic sponge.

4. The scrubber of claim 1 wherein the scrubbing pad is formed of an open cell polyether sponge.

5. The scrubber of claim 4 wherein the open cell polyether sponge has a linear cell count of about 20 PPI plus or minus 10 PPI.

6. A scrubber for the outside side face of a rain gutter having a ogee-curve portion, an upwardly extending portion terminating in a flat flange and a downwardly extending portion terminating in a flat floor, said scrubber comprising a substantially flat backing plate with a removable scrubbing pad and a handle, said substantially flat backing plate having at least one hookstrip on a bottom surface for removable attachment of the scrubbing pad, said handle connected with a double swivel joint assembly to the flat backing plate, said scrubbing pad having a bottom surface complementary to the ogee-curve portion of the side face of the rain gutter, complementary to the upwardly extending portion and overlapping a portion of the flat flange and complementary to the downwardly extending portion and overlapping a portion of the flat floor, said scrubbing pad formed of a reticulated open cell polyether sponge.

7. The scrubber of claim 6 wherein the reticulated open cell polyether sponge has a linear cell count of about 20 PPI plus or minus 10 PPI.

8. The scrubber of claim 7 wherein the double swivel joint assembly is threaded for threaded attachment to a pole such that the scrubber may used from the ground to reach a rain gutter installed along the eave line of a structure.

9. The scrubber of claim 6 wherein the scrubbing pad keeps its shape and is not affected by cleaners or bleach.

10. The scrubber of claim 9 wherein the scrubbing pad is resistant to hydrolysis.

* * * * *